US010400987B2

(12) United States Patent
Corkill

(10) Patent No.: US 10,400,987 B2
(45) Date of Patent: Sep. 3, 2019

(54) LIGHT FIXTURE ASSEMBLY INCLUDING A REFLECTOR

(71) Applicant: Kirby Corkill, Chicago, IL (US)

(72) Inventor: Kirby Corkill, Chicago, IL (US)

(73) Assignee: Jarvis Corp., Elk Grove Village, IL (US)

( * ) Notice: Subject to any disclaimer, the term of this patent is extended or adjusted under 35 U.S.C. 154(b) by 0 days.

(21) Appl. No.: 14/609,672

(22) Filed: Jan. 30, 2015

(65) Prior Publication Data

US 2017/0292676 A1 Oct. 12, 2017

(51) Int. Cl.

| | |
|---|---|
| ***F21V 7/00*** | (2006.01) |
| ***F21V 7/05*** | (2006.01) |
| ***F21K 9/68*** | (2016.01) |
| ***F21S 8/00*** | (2006.01) |
| *F21S 8/08* | (2006.01) |
| *F21V 13/04* | (2006.01) |
| *F21W 131/10* | (2006.01) |
| *F21Y 115/10* | (2016.01) |

(52) U.S. Cl.

CPC ..... *F21V 7/0008* (2013.01); *F21K 9/68* (2016.08); *F21S 8/033* (2013.01); *F21V 7/05* (2013.01); *F21S 8/08* (2013.01); *F21V 13/04* (2013.01); *F21W 2131/10* (2013.01); *F21Y 2115/10* (2016.08)

(58) Field of Classification Search

CPC ..... F21S 8/024; F21S 8/033; F21V 7/0008; F21W 2131/10

USPC ..... 362/147

See application file for complete search history.

(56) References Cited

U.S. PATENT DOCUMENTS 3,340,393 A * 9/1967 Franck ..... F21S 8/033 362/309

2008/0273333 A1* 11/2008 Berns ..... F21S 8/083 362/294

(Continued)

FOREIGN PATENT DOCUMENTS

JP WO 2014034778 A1 * 3/2014 ..... B41J 11/002

OTHER PUBLICATIONS

Uchida, Light irradiation apparatus, and printing apparatus, Mar. 6, 2014, PCT Publication of PCT/JP2013/073139; Google Patents, https://patents.google.com/patent/WO2014034778A1/en.*

*Primary Examiner* — Anh T Mai
*Assistant Examiner* — Michael Chiang
(74) *Attorney, Agent, or Firm* — Jovan N. Jovanovic; The Watson IP Group, PLC

(57) ABSTRACT

A light fixture assembly configured to direct light outwardly and downwardly, while precluding the directing of light upwardly. The light fixture assembly comprises a housing, an LED light and a reflector. The LED light includes a mounting surface and a light emitting member. The mounting surface is coupled to the housing, and in particular on an inside surface of the upper side wall, with the light being directed in at least a downward direction. The reflector includes a second portion which is positioned within the inner cavity and below the LED light. The second portion is angled at least at 45° relative to a horizontal axis in an operational configuration. The reflector directs light imparted by the light emitting member in at least one of a downward and an outward direction, while precluding the directing of light imparted by the light emitting member in an upward direction.

10 Claims, 3 Drawing Sheets

(56) References Cited

U.S. PATENT DOCUMENTS

| | | | | |
|---|---|---|---|---|
| 2011/0060701 | A1* | 3/2011 | Verfuerth | F21S 8/086<br>705/500 |
| 2014/0177228 | A1* | 6/2014 | Ellingson | F21V 29/004<br>362/294 |
| 2015/0276196 | A1* | 10/2015 | Uchida | B41J 11/002<br>347/102 |

* cited by examiner

LIGHT FIXTURE ASSEMBLY INCLUDING A REFLECTOR

CROSS-REFERENCE TO RELATED APPLICATION

N/A

BACKGROUND OF THE DISCLOSURE

1. Field of the Disclosure

The invention relates in general to light fixtures, and more particularly, to a light fixture that utilizes a LED light, and that directs light output in a downward and outward direction, while precluding emission of light in an upward direction.

2. Background Art

Light fixtures are often utilized in various settings to illuminate objects. Typically, light fixtures, especially in commercial settings, direct all of their output in a downward direction. This is because the entirety of the light can be utilized to illuminate objects. Indeed, lights that emit in an upward direction are deemed to be wasteful. Indeed, any light sent in an upward direction results in a waste of energy. That is, a smaller light could have been utilized if all of the light could have been captured and sent in a downward and outward direction. In addition such wasted light creates light pollution. The term often utilized for such lights that do not send light in an upward direction is "full cut-off" light fixtures.

Incidentally, many programs sponsored by government provide rebates and the like to encourage replacement of old lights with newer more energy efficient lights. Generally, outdoor LED replacement lights must meet the "full cut-off" requirements to qualify as energy efficient replacements.

Typically, LED lights that qualify for such programs typically achieve the "full cut-off" by using a horizontally positioned lens with an LED light mounted above the lens. The housing above the LED light forms the physical barrier that prevents light from emitting in an upward direction.

Problematically, such LED lights typically emit in a downward direction, but not outwardly. In many applications, it is required that the lights have a horizontal or outward light throw. As such, the light, it is desired, is directed downwardly and outwardly. While these lights can illuminate a wide area around a particular space, the optical control is typically not very precise, and a large amount of the light can be sent in the upward direction. Any such light is deemed to be wasted. Additionally, such lights would not qualify for the energy efficiency rebates and programs.

It is therefore an object of the present disclosure to provide for an improved LED light assembly that can direct light outwardly and downwardly while minimizing, limiting, and/or eliminating the direction of light in an upward direction.

SUMMARY OF THE DISCLOSURE

The disclosure is directed to a light fixture assembly configured to direct light outwardly and downwardly, while precluding the directing of light upwardly. The light fixture assembly comprises a housing, an LED light and a reflector. The housing including a wall mount surface, and a plurality of side walls extending therefrom. One of the side walls comprising an upper side wall. The side walls and the wall mount surface defining an inner cavity and an outer edge. The outer edge defining an opening providing ingress into the inner cavity. A lens extends over at least a portion of the opening. The LED light includes a mounting surface and a light emitting member. The mounting surface is coupled to the housing, and in particular on an inside surface of the upper side wall, with the light being directed in at least a downward direction. The reflector includes a second portion which is positioned within the inner cavity and below the LED light. The second portion is angled at least at 45° relative to a horizontal axis in an operational configuration. The reflector directs light imparted by the light emitting member in at least one of a downward and an outward direction, while precluding the directing of light imparted by the light emitting member in an upward direction.

In some configurations, the upper side wall is oblique to the wall mount surface. Upon positioning of the LED light thereon, the light emitting member directs at least a portion of light in a downward direction and in an inward direction toward the wall mount surface.

In some configurations, the lens is one of parallel and oblique to the wall mount surface.

In some configurations, the reflector further includes a first portion that extends from the upper side wall to the second portion. The first portion is angled at an angle different than that of the second portion so that the first and second portions are angled relative to each other.

In some configurations, the first portion is substantially parallel to the wall mount surface.

In some configurations, the housing includes a base portion and an outer portion. The base portion includes the wall mount surface. The outer portion includes the lens. The base portion and the outer portion being hingedly coupled to each other.

In some configurations, the second portion of the reflector is substantially planar.

In some configurations, the reflector is configured to extend across the entirety of the lens, so as to correspond therewith.

In some configurations, the housing is formed from a polymer based material.

In some configurations, the wall mount surface is substantially oblique to the second reflector and substantially oblique with the lens.

BRIEF DESCRIPTION OF THE DRAWINGS

The disclosure will now be described with reference to the drawings wherein:

FIG. 1 of the drawings is a perspective view of the light fixture assembly of the present disclosure, showing, in particular, the light fixture mounted on an outside surface, such as, for example, a wall or the like;

DETAILED DESCRIPTION OF THE DISCLOSURE

Figure 1:
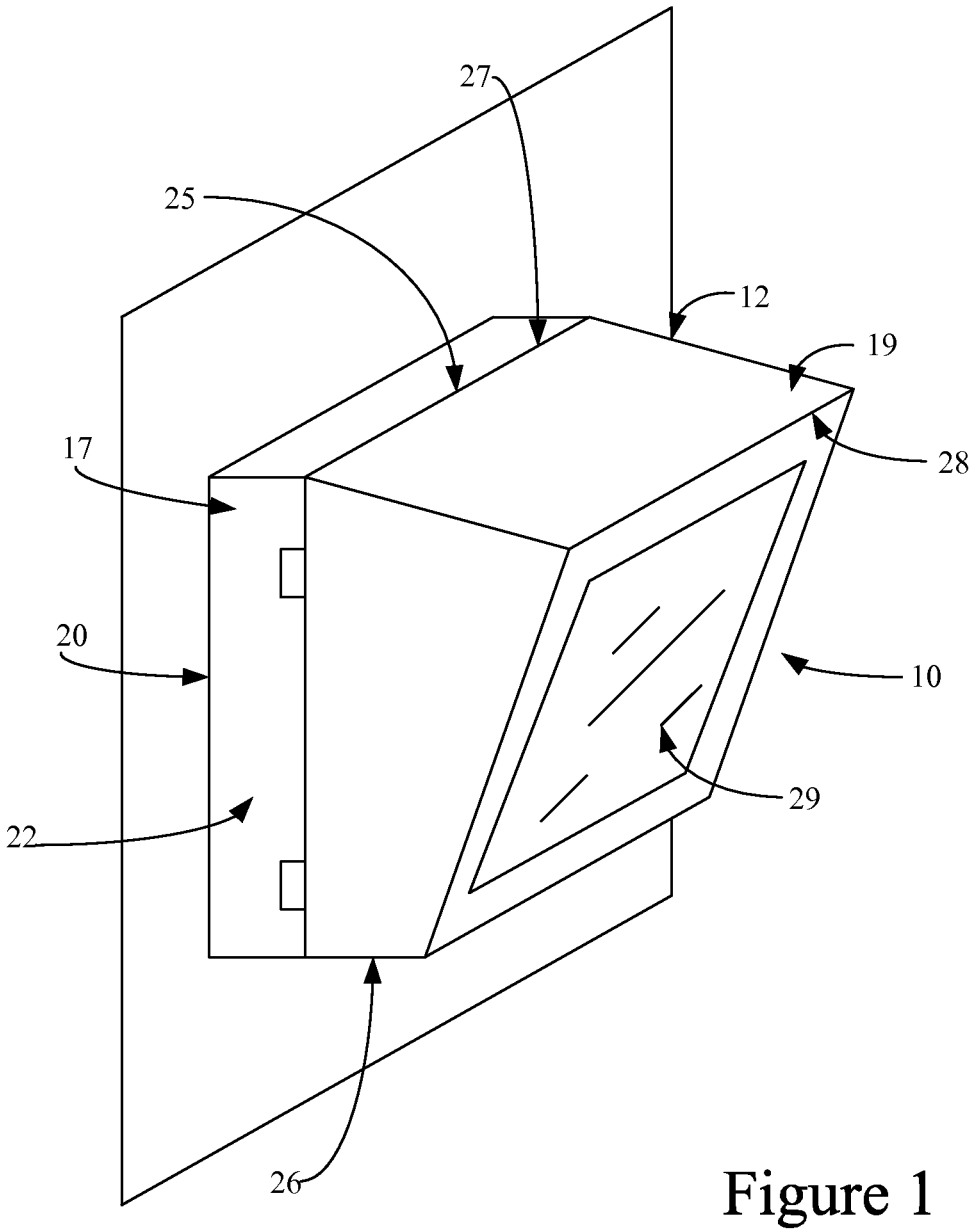
Figure 2:
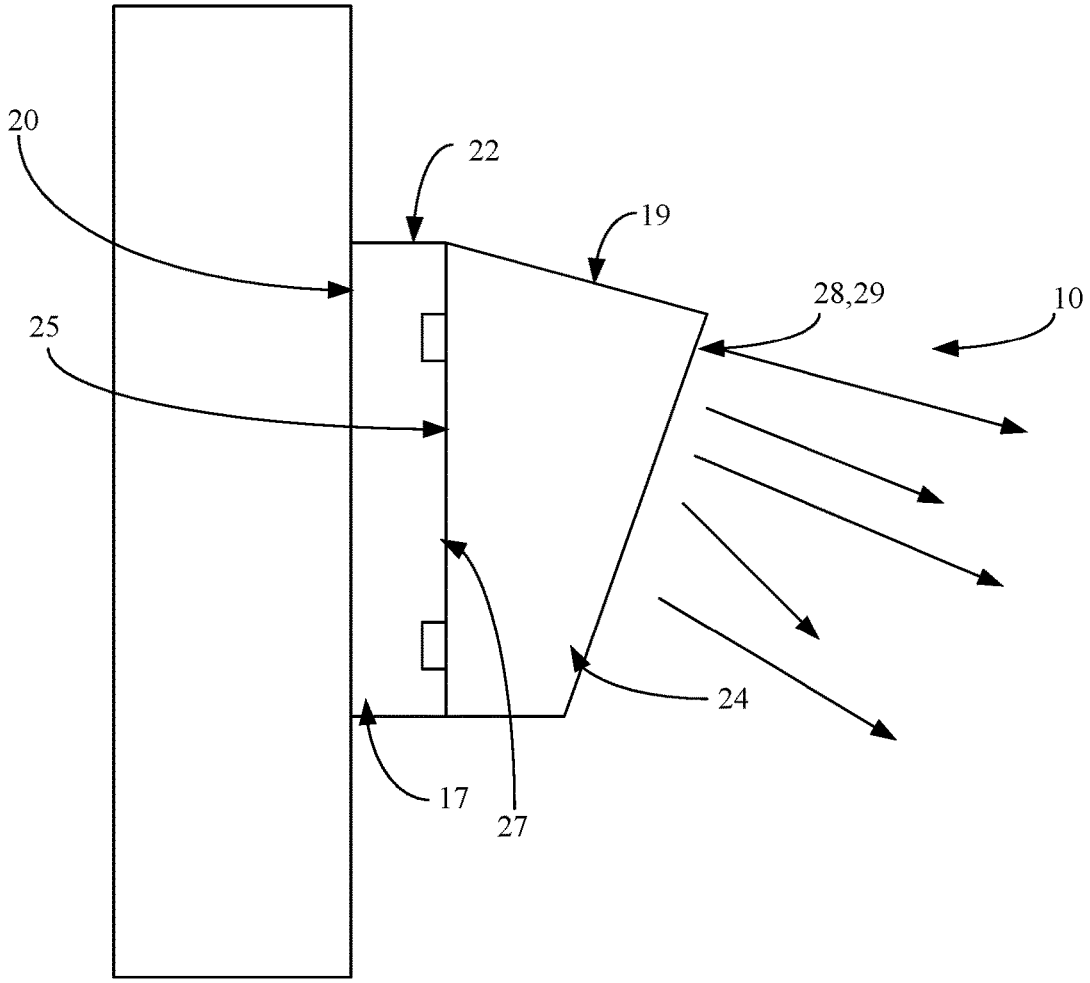
FIG. 2 of the drawings is a side elevational view of the light fixture assembly of the present disclosure, showing, the hinged coupling between the base portion and the outer portion.
Figure 3:
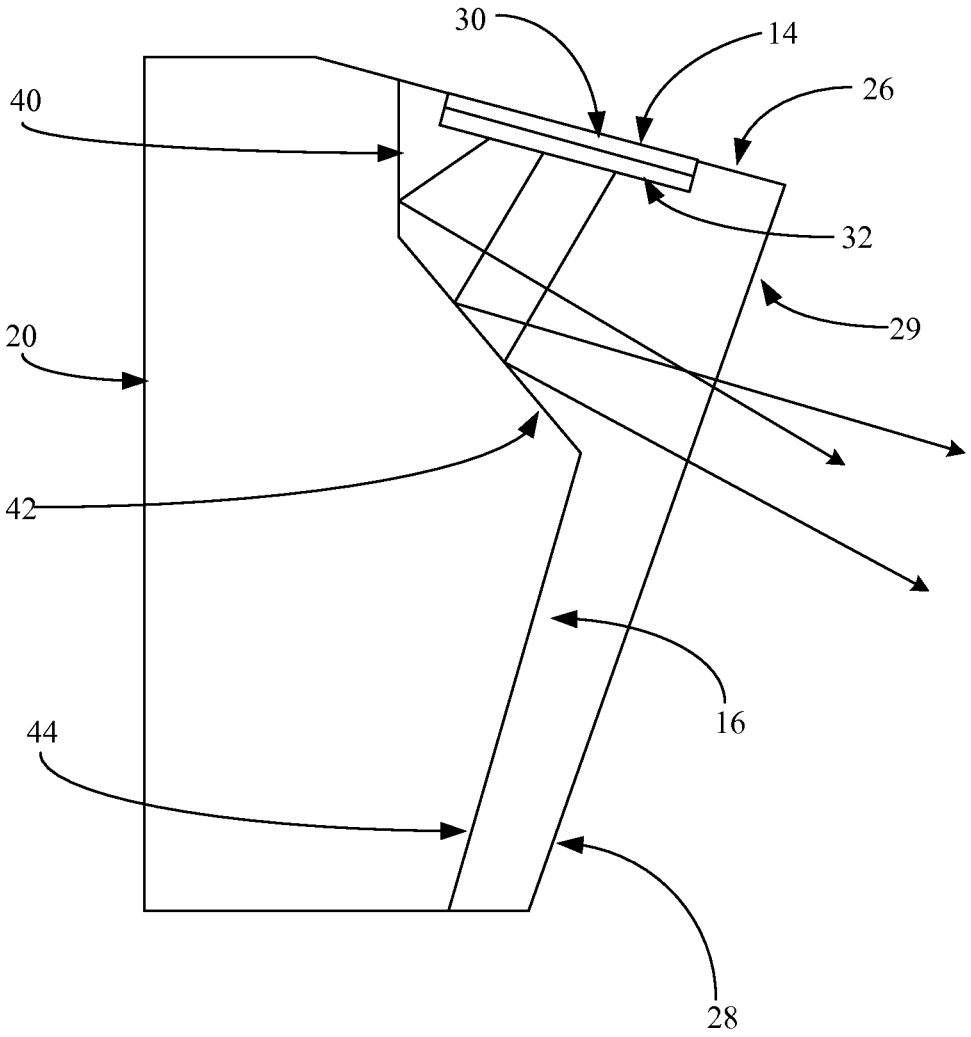
FIG. 3 of the drawings is a cross-sectional view of the light fixture assembly of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 though 3, the light fixture assembly is shown generally at 10. The light fixture is typically suitable for coupling to an existing wall, such as the wall of a building or other structure. Of course, it is likewise contemplated that the light fixture may be coupled to a pole or other structure. Indeed, the particular structure to which the light fixture is attached is not to be deemed limiting, and any examples should be considered to be exemplary and not for purposes of limitation.

The light fixture assembly 10 includes housing 12, LED light 14 and reflector 16. As will be explained below, the housing comprises two portions that can be separated from each other to provide access to an inner cavity. The LED light and the reflector can be maintained within the inner cavity. The housing 12, more particularly includes base portion 17 and outer portion 19. The two portions are joined together about their peripheral edges to from the inner cavity. With more specificity, the base 17 includes wall mount surface 20 and side walls 22. The wall mount surface 20 may include a plurality openings or the like to allow for the coupling of fasteners and the like. In the configuration shown, the wall mount surface 20 is substantially rectangular. The side walls 22 cooperate with the wall mount surface to define inner cavity 24, and outer edge 25 which defines an opening into the inner cavity 24. In the configuration shown, the base 17 defines a relatively shallow inner cavity, while other configurations are likewise contemplated.

The outer portion 19 includes side walls 26 which define inner edge 27 and outer edge 29. The inner and outer edges define openings. In the configuration shown, the inner edge 27 matches and corresponds to the outer edge 25 of the base portion 17 to matingly, and sealingly engage. In the configuration shown, the base portion 17 and the outer portion 19 are coupled together through a pair of hinges from one side and a locking mechanism opposite the hinges. Of course, other configurations are likewise contemplated.

The inner edge 27 and the outer edge 28 are generally disposed at an angle relative to each other, such that the plane defined by the outer edge 28 is substantially oblique to the inner edge and to the outer edge 25 of the base portion 17. In the configuration shown, the wall mount surface is substantially planar and substantially parallel to the wall surface. The outer edge 25 of the base portion 17 defines a plane which is substantially parallel to the wall mount surface. As the inner edge 27 matingly engages the outer edge 25, the inner edge 27 is likewise substantially parallel to the wall mount. The outer edge 28 is oblique thereto such that it is angled toward the ground and away from the air. In other embodiments, the outer edge 28 may be parallel to the inner edge and to the wall mount surface.

A lens is positioned so as to cover the opening defined by the outer edge 28. The lens may comprise a transparent lens that may be made of glass or a polymer. In other configurations, the lens may be translucent. Various different materials are contemplated for use. In the configuration shown, the lens is shown as being substantially planar, however, it is likewise contemplated that in other configurations, the lens may be shaped, such as, for example, an outwardly convex configuration.

In the configuration shown, the housing is formed from a molded polymer material. It is contemplated that in other configurations, other materials may be utilized, including but not limited to composites, polymers, metals and alloys thereof, as well as combinations of the foregoing. It is likewise contemplated that the housing may comprise a single integrally molded member wherein the lens, for example, is removed for access to the inner cavity. In other embodiments, a separate door or access door may be provided in an otherwise integrally molded member.

The LED light 14 is shown as including a mounting surface 30 and a light emitting portion 32. In the configuration shown, the LED light 14 is coupled by way of the mounting surface 30 to the upper one of the side walls 26 of the outer portion 19 of the housing. That upper side wall extends oblique or perpendicular to the wall mount surface, such that the light emitting portion 32 extends in a direction that is other than upward. In particular, in the configuration shown, the light emitting portion extends downwardly and also slightly inclined inwardly toward the wall mount surface. The light is physically positioned with an opaque member thereabove so as to preclude direct transmission of light in an upward direction. It will be understood that the light emitting portion generally emits in a lambertian pattern, and in the figures shown, the center of the pattern is directed inwardly. It is understood that the center of the lambertian pattern may be positioned to be directed inwardly, downwardly or outwardly, with the inwardly directed portion being reflected outwardly.

The reflector 16 is shown in FIG. 1 as comprising first portion 40, second portion 42 and third portion 44. It will be understood that the reflector 16 is positioned to direct the light from the LED light downwardly and outwardly. Advantageously, the position of the reflector allows for the spreading of light outwardly, while also directing the light downwardly, all while precluding the upward loss of light. The first portion 40 is generally angled at an orientation that is substantially parallel with the wall mount surface, thereby directing light in a generally downward and outward direction due to the position relative to the LED light. The first portion 40 is positioned between the LED light and the wall mount surface, and also extending from the upper side wall of the outer portion between opposing side portions of the side walls. The second portion 42 is generally positioned oblique to the first portion and at an angle of at least 45° relative to the horizontal. As such, the relationship between the first portion, the second portion and the orientation of the LED light allows for horizontal or downward light, with the exclusion of upward light. As such, a full cut-off is achieved, with none of the light being extended upwardly.

In the configuration shown, the third portion 44 extends from the end of the second portion and toward the lower wall of the sidewalls 26 of the outer portion. In the configuration shown, the third portion substantially matches the angle and position of the lens and is more directed to finishing the configuration. Generally light is not typically reflected from the third portion 44. In other configurations, the position of the reflectors can be changed, with the third portion being omitted. It will also be understood that more than three portions may be presented. For example, an additional portion may be positioned between the first and second portions, or between the second and third portions. Alternatively, a single portion may be utilized, with sub-portions defined by different surface variations (in the case of a molded reflector member).

It will be understood that each of the portions 40, 42 and 44 span across the lens from side to side and extend from each other end to end. In the configuration shown, the three portions are substantially planar (and oblique to each other), whereas it is likewise contemplated that the portions may be convex and/or molded shapes. Such shapes would allow for greater side-to-side light dispersion, while maintaining the vertical relationship with the LED light 14. It is also understood that the portions may be combined in operation, and that at least a portion of the reflector is entirely steeper than the 45° at any point thereof. For example, a single curved unit may be utilized.

In use, it will be understood that the light is mounted on an outside surface, such as a building, a pole, a wall or the like. In particular, the housing, and the wall mount surface 20 thereof is coupled to such an outside structure. Once coupled, the LED light can be coupled to an electrical current (that is, the LED can be coupled to a power source). It will be understood that within the cavity, transformers, resistors, capacitors, IC chips and other circuit elements may be present to transform the power provided into power that can be utilized by the LED light.

Once the LED light is energized, the light exits from the LED toward the reflector, and in particular, the first portion 40, the second portion 42 and the third portion 44 thereof. Due to the position of the reflector portions, the light from the LED is directed in an downward and an outward direction. However, due to the position of the reflectors, the light is not directed in an upward direction. As such, the lights have a forward throw, while qualifying as a "full cut-off" light.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A light fixture assembly configured to direct light outwardly and downwardly, while precluding the directing of light upwardly, the light fixture assembly comprising:

a housing including a wall mount surface, and a plurality of side walls extending therefrom, one of the side walls comprising an upper side wall, the side walls and the wall mount surface defining an inner cavity and an outer edge, the outer edge defining an opening providing ingress into the inner cavity, and, a lens extending over at least a portion of the opening;

an LED light including a mounting surface and a light emitting member, the mounting surface coupled to the housing, and in particular on an inside surface of the upper side wall, with the light being directed in at least a downward direction; and a reflector including a portion which is positioned within the inner cavity and below the LED light that is inclined inwardly toward the wall mount surface, the portion being angled at least at 45° relative to a horizontal axis in an operational configuration so as to be opposite of the LED light and facing the LED light and the upper sidewall, and to form an acute angle therewith, the reflector directing the light imparted by the light emitting member in at least one of a downward and an outward direction, while precluding the directing of the light imparted by the light emitting member in an upward direction.

2. The light fixture assembly of claim 1 wherein the upper side wall is oblique to the wall mount surface, such that upon positioning of the LED light thereon, the light emitting member directs at least a portion light in a downward direction and in an inward direction toward the wall mount surface.

3. The light fixture assembly of claim 2 wherein the lens is one of parallel and oblique to the wall mount surface.

4. The light fixture assembly of claim 3 wherein the portion is a second portion, the reflector further includes a first portion that extends from the upper side wall to the second portion, the first portion being angled at an angle different than that of the second portion so that the first and second portions are angled relative to each other.

5. The light fixture assembly of claim 4 wherein the first portion is substantially parallel to the wall mount surface.

6. The light fixture assembly of claim 5 wherein the housing includes a base portion and an outer portion, the base portion including the wall mount surface, and the outer portion including the lens, with the base portion and the outer portion being hingedly coupled to each other.

7. The light fixture of claim 5 wherein the second portion of the reflector is substantially planar.

8. The light fixture of claim 7 wherein the reflector is configured to extend across the entirety of the lens, so as to correspond therewith.

9. The light fixture of claim 8 wherein the housing is formed from a polymer based material.

10. The light fixture of claim 9 wherein the wall mount surface is oblique to the second portion and oblique with the lens.

* * * * *